US005668850A

United States Patent [19]

Abdel-Malek

[11] Patent Number: 5,668,850

[45] Date of Patent: Sep. 16, 1997

[54] SYSTEMS AND METHODS OF DETERMINING X-RAY TUBE LIFE

[75] Inventor: Aiman Albert Abdel-Malek, Schenectady, N.Y.

[73] Assignee: General Electric Company, Schenectady, N.Y.

[21] Appl. No.: 652,210

[22] Filed: May 23, 1996

[51] Int. Cl.[6] ..... H05G 1/08

[52] U.S. Cl. ..... 378/210; 378/19

[58] Field of Search ..... 378/16, 19, 210

[56] References Cited

U.S. PATENT DOCUMENTS

| | | | |
|---|---|---|---|
| 4,158,138 | 6/1979 | Hellstrom | 378/116 |
| 4,160,906 | 7/1979 | Daniels et al. | 378/97 |
| 4,817,015 | 3/1989 | Insana et al. | 364/507 |
| 5,132,999 | 7/1992 | Wirth | 378/101 |
| 5,245,589 | 9/1993 | Abel et al. | 367/136 |
| 5,253,530 | 10/1993 | Letcher, III | 73/602 |
| 5,265,146 | 11/1993 | Wirth et al. | 378/93 |
| 5,347,479 | 9/1994 | Miyazaki | 364/725 |
| 5,388,182 | 2/1995 | Benedetto et al. | 395/214 |
| 5,392,255 | 2/1995 | LeBras et al. | 367/50 |
| 5,414,780 | 5/1995 | Carnahan | 382/276 |
| 5,420,636 | 5/1995 | Kojima | 348/403 |
| 5,420,891 | 5/1995 | Akansu | 375/350 |

OTHER PUBLICATIONS

"Orthonormal Bases of Compactly Supported Wavelets & Dev.", by Ingrid Daubechies, *Communications on Pure and Applied Mathematics,* vol. XLI 909–996 (1988), pp. 909–996.

"A Theory for Multiresolution Signal Decomposition: The Wavelet Representation", by Stephane G. Mallat, *IEEE Transactions on Pattern Analysis and Machine Intelligence,* vol. 11, No. 2, Jul. 1989, pp. 674–693.

"The Wavelet Transform, Time–Frequency Localization and Signal Analysis", by Ingrid Daubechies, *IEEE Transactions on Information Theory,* vol. 36, No. 5, Sep. 1990, pp. 961–1005.

"Characterization of Signals from Multiscale Edges", by Stephane Mallat and Sifen Zhong, *IEEE Transactions on Pattern Analysis and Machine Intelligence,* vol. 14, No. 7, Jul. 1992, pp. 710–732.

"Numerical Recipes in Fortran—The Art of Scientific Computing Second Edition", by William H. Press et al., Cambridge University Press 1986, pp. 584–599.

*Primary Examiner*—David P. Porta
*Assistant Examiner*—David Vernon Bruce
*Attorney, Agent, or Firm*—Marvin Snyder

[57] ABSTRACT

A method and apparatus to facilitate avoiding failure of a computed tomography x-ray source while performing a patient scan permits detection of the onset of a potential x-ray source failure and estimation of the x-ray source life expectancy. The information obtained can be used in deciding whether to repair or replace an x-ray source prior to failure. In one embodiment, signals I(x,y) representative of the x-ray beam optical focal spot detected by a detector array are sampled, and a wavelet transform is applied to the sampled signals I(x,y) to generate at least one energy level $F_{new}$ for a wavelet band. The energy level $P_{new}$ is compared with stored energy levels $P_{stored}$ to identify one of the energy levels $P_{stored}$ which, when subtracted from energy level $P_{new}$, results in a statistically non-significant value. The remaining life of the x-ray source is estimated as being equal to the life expectancy value corresponding to the identified energy level $P_{stored}$.

14 Claims, 4 Drawing Sheets

SYSTEMS AND METHODS OF DETERMINING X-RAY TUBE LIFE

FIELD OF THE INVENTION

This invention relates generally to x-ray systems and, more particularly, to detecting the onset of x-ray tube failure and determining the remaining x-ray tube life.

BACKGROUND OF THE INVENTION

In at least one known x-ray imaging system configuration, commonly known as a computed tomography (CT) system, an x-ray source projects a fan-shaped beam which is collimated to lie within an X-Y plane, generally referred to as the "imaging plane", of a Cartesian coordinate system. The x-ray beam passes through the object being imaged, such as a patient. After being attenuated by the object, the beam impinges upon an array of radiation detectors. Intensity of the attenuated beam radiation received at the detector array is dependent upon the attenuation of the x-ray beam by the object. Each detector element of the array produces a separate electrical signal that is a measurement of the beam attenuation at the detector location. The attenuation measurements from all the detectors are acquired separately to produce a transmission profile.

The x-ray source typically includes a cathode and an anode that emits x-rays during operation. In one known x-ray source, the cathode includes a tungsten thermionic emitting source and focusing surfaces. A filament heats the cathode to an operating temperature and, upon application of a potential across the cathode and anode, the cathode produces thermionically emitted electrons which traverse a vacuum gap to the anode and impact the anode at a focal spot, thereby generating x-rays.

In the known x-ray source described above, the anode rotates at a high speed so that heat generated at the focal spot is distributed over the anode surface. Distributing the heat over the anode surface is particularly important in diagnostic x-ray applications, such as cardiac interventional procedures, that require high focal spot intensities.

In the known x-ray source, the anode is rotated by an induction motor having a cylindrical rotor coupled to a cantilevered axle that supports a disc-shaped x-ray tube anode. The rotor is supported by ball bearings in the cantilevered axle, sometimes referred to as a rotor cage. The rotor is often required to rotate at speeds reaching 17,000 revolutions per minute (rpm). The ball bearings thus have to satisfy exceptional demands.

As the ball bearings and rotor wear, the rotation of the anode may be adversely affected. For example, anode revolutions per minute may decrease or the anode may not rotate concentrically. Eventually, if the worn components are not repaired or replaced, the x-ray source will fail.

Failure of an x-ray source, particularly if such failure occurs while performing a patient scan, is highly undesirable. For example, if an x-ray source fails during a scan, the patient dose may exceed the intended level. Therefore, it would be desirable to provide apparatus and methods for quickly and easily detecting the onset of a potential x-ray source failure. It also would be desirable to provide a system which estimates x-ray source life expectancy so that unexpected x-ray source failures can be avoided.

SUMMARY OF THE INVENTION

The invention, in one aspect, is a method for estimating the remaining life of an x-ray source. More specifically, and in accordance with one embodiment of the invention, focal spot spectral parameters $P_{stored}$ representing optical focal spot energy levels for different life expectancy values of an x-ray source are predetermined and stored in a look-up table. The look-up table may be contained, for example, in the memory of a computer in a CT system using an x-ray source similar to the x-ray source used in generating parameters $P_{stored}$.

Once parameters $P_{stored}$ are generated and stored as described above, the operating life of the x-ray source can be periodically estimated. Specifically, and if the x-ray source forms part of a CT imaging system, signals I(x,y) representative of the x-ray beam optical focal spot are detected by the CT system detector array. A wavelet transform is applied to the sampled signals I(x,y) to generate at least one energy level $P_{new}$ for a wavelet band. Then, for each band, the energy level $P_{new}$ is compared with the stored energy levels $P_{stored}$ to identify an energy level $P_{stored}$ which, when subtracted from energy level $P_{new}$, results in a statistically non-significant difference. The remaining life of the x-ray source is then estimated as being equal to the life expectancy for the identified energy level $P_{stored}$.

The above described method facilitates avoidance of failure of an x-ray source while performing a patient scan since it enables detection of the onset of a potential x-ray source failure, allowing the remaining x-ray source life expectancy to be estimated. Such information can be used in deciding whether to repair or replace an x-ray source prior to its failure.

BRIEF DESCRIPTION OF THE DRAWINGS

The features of the invention believed to be novel are set forth in the appended claims. The invention, however, together with further objects and advantages thereof, may best be understood by reference to the following description taken in conjunction with the accompanying drawing(s) in which:

DETAILED DESCRIPTION OF THE DRAWINGS

Figure 1:
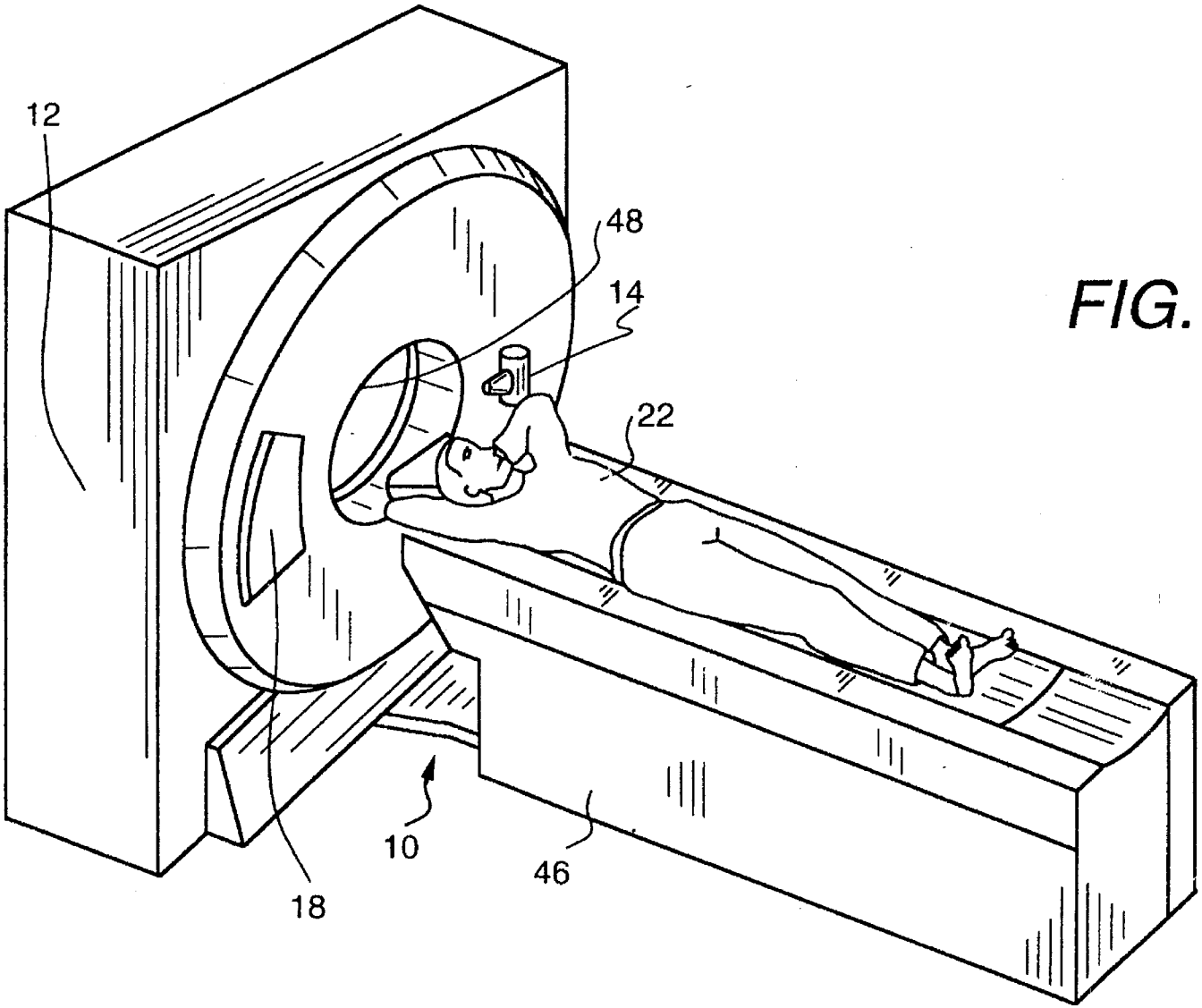
FIG. 1 is a perspective view depicting a CT imaging system.
Figure 2:
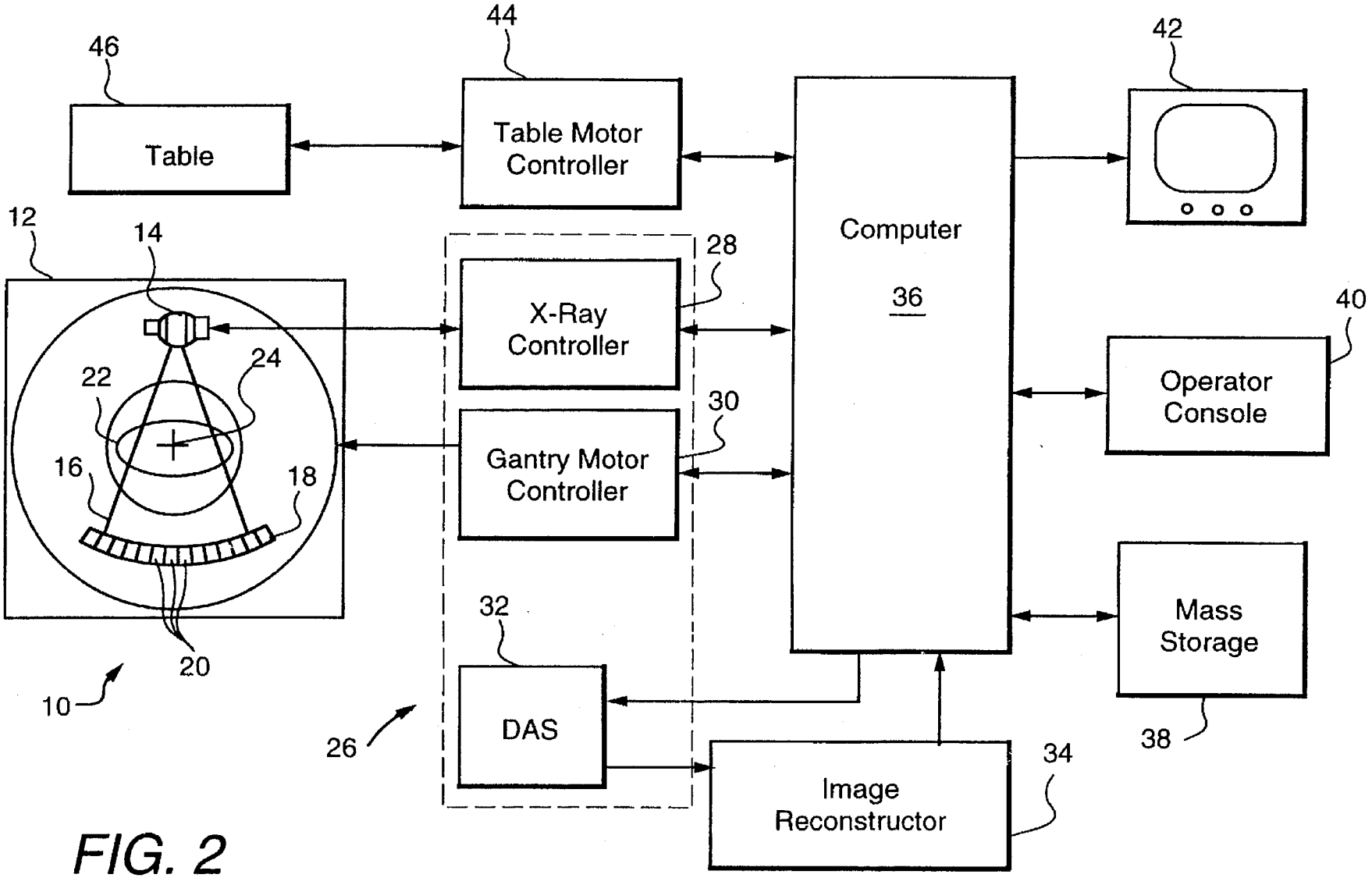
FIG. 2 is a block diagram of the system illustrated in FIG. 1.

In FIGS. 1 and 2, a CT imaging system 10 is shown as including a gantry 12 representative of a "third generation" CT scanner. Gantry 12 carries an x-ray source 14 that projects a beam of x-rays 16 toward a detector array 18 carried on the opposite side of the gantry. Detector array 18 is formed by detector elements 20 which together sense the projected x-rays that pass through a medical patient 22. Each detector element 20 produces an electrical signal that represents intensity of an impinging x-ray beam and hence attenuation of the beam as it passes through patient 22. During a scan to acquire x-ray projection data, gantry 12 and the components mounted thereon rotate about a center of rotation 24.

Rotation of gantry 12 and operation of x-ray source 14 are governed by a control mechanism 26, which includes an x-ray controller 28 that provides power and timing signals to x-ray source 14 and a gantry motor controller 30 that controls the rotational speed and position of gantry 12. A data acquisition system (DAS) 32 in control mechanism 26 samples data from detector elements 20 and converts the data to digital signals for subsequent processing. An image reconstructor 34 receives digitized x-ray data from DAS 32 and performs high speed image reconstruction. The reconstructed image is applied as an input signal to a computer 36 which stores the image in a mass storage device 38.

Computer 36 also receives commands and scanning parameters from an operator via a console 40 that includes a keyboard. An associated cathode ray tube display 42 allows the operator to observe the reconstructed image and other data from computer 36. The operator-supplied commands and parameters are used by computer 36 to provide control signals and information to DAS 32, x-ray controller 28 and gantry motor controller 30. In addition, computer 36 operates a table motor controller 44 which controls a motorized table 46 to position patient 22 in gantry 12. Particularly, table 46 moves portions of patient 22 through a gantry opening 48.

Figure 3:
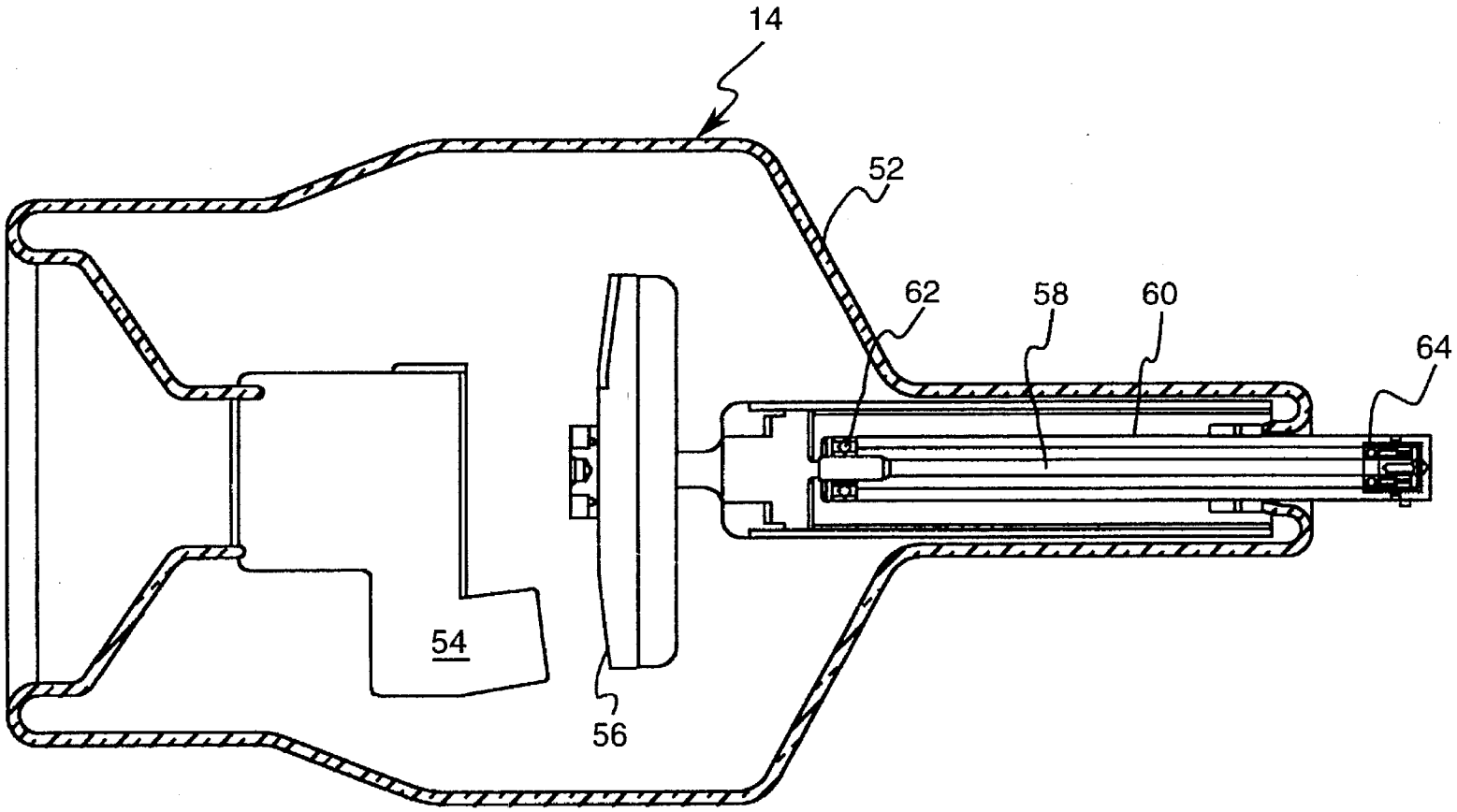
FIG. 3 is a cross-sectional schematic view of a typical x-ray source.

As shown in FIG. 3, x-ray source 14 includes a housing 52 having a cathode 54 and an anode 56 mounted therein. Anode 56 is coupled to, and driven by, a rotor 58 rotatably mounted in a rotor cage 60 and supported therein by ball bearings 62 and 64. A motor (not shown) couples to and drives, i.e., rotates, rotor 58.

In operation, cathode 54 is heated to an operating temperature and a potential is applied across cathode 54 and anode 56. In addition, the motor drives rotor 58 so that anode 56 rotates. As anode 56 rotates, thermionically emitted electrons traverse the vacuum gap between cathode 54 and anode 56. The emitted electrons impact rotating anode 56 at a focal spot, thereby generating x-rays. Heat formed at the focal spot of anode 56 is distributed over the surface of anode 56. The geometry of the focal spot formed on anode 56 is determined by the anode area covered by the electrons and the electron distribution over anode 56. The projection of this anode area in the imaging direction is the effective focal spot size, sometimes referred to as the optical focal spot.

As explained above, rotor 58 is often required to rotate at speeds reaching 17,000 revolutions per minute (r.p.m.). Any excessive wear of bearings 62 and 64 may, of course, adversely affect operation of anode 56 and could lead to failure of source 14. The onset of any such failure of source 14 should be detected early and quickly, and preferably, the life expectancy of source 14 is predicted so that components of source 14 can be repaired or replaced prior to the onset of any failure.

CT imaging system 10 and x-ray source 14 are shown for illustrative purposes only. The present x-ray source life prediction system and method can be utilized in connection with various types of digital x-ray systems, such as x-ray systems used for cardiovascular procedures, e.g., digital subtraction angiography. Therefore, although the ensuing discussion refers specifically to CT imaging system 10 and x-ray source 14, it should be understood that the present invention is not limited to practice in connection with such a system.

The invention, in one form, is a method for detecting the onset of x-ray source failure and also for predicting the remaining useful life of an x-ray source, e.g., source 14. In CT system 10 (FIGS. 1 and 2), for example, the method is practiced by computer 36 using digital data supplied by DAS 32. In accordance with the one embodiment of the invention, both the spatial geometry and frequency spectrum of the optical focal spot are analyzed. The onset of any x-ray source failure and a remaining life prediction are generated as a result of such analysis.

Figure 4:
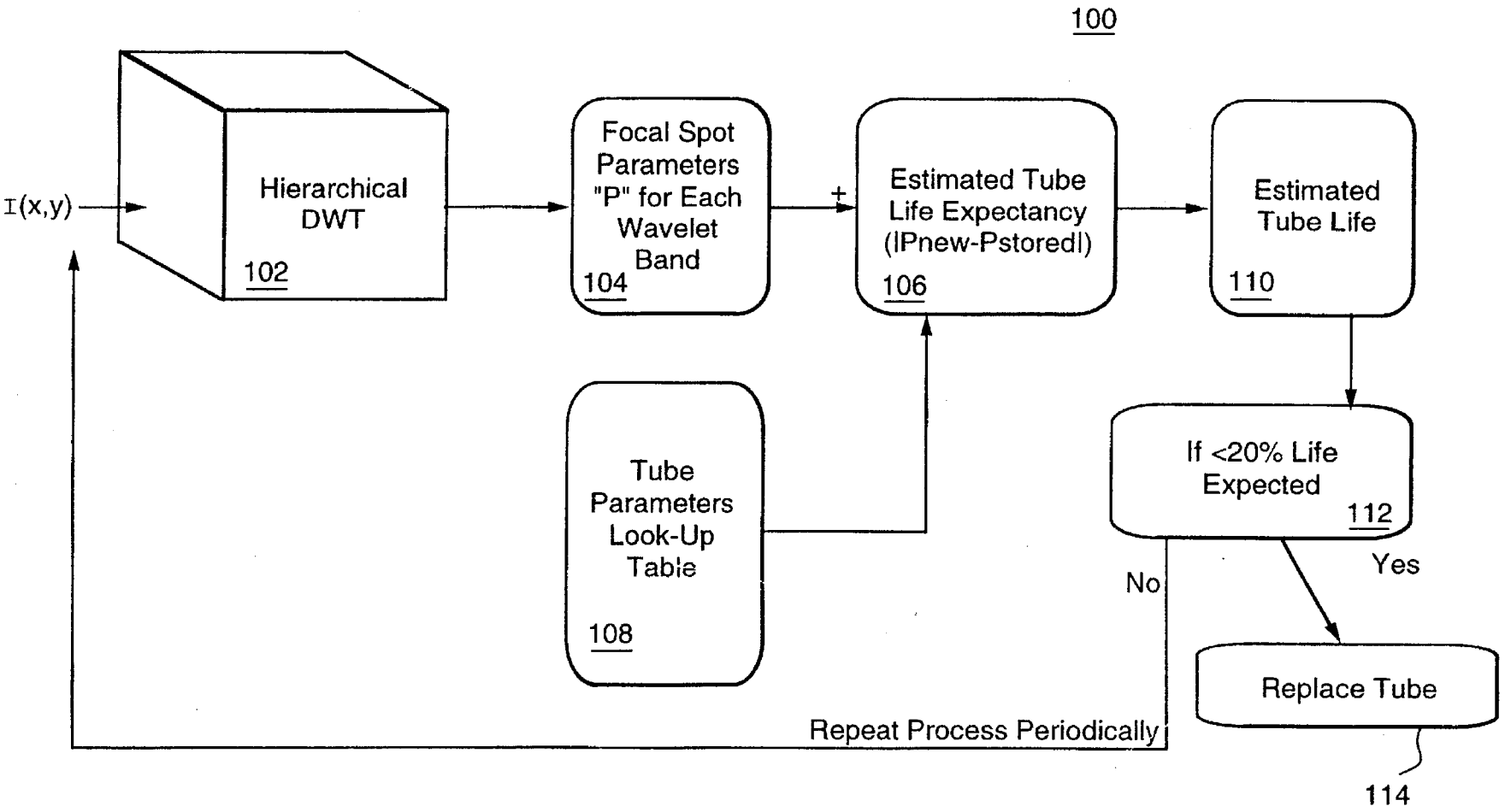
FIG. 4 is a flow chart illustrating a sequence of process steps in accordance with one embodiment of the invention.

FIG. 4 is a flow chart 100 illustrating a sequence of process steps executed by computer 36 (FIG. 1). Prior to executing the algorithm represented in flow chart 100, a look-up table is generated through use of known x-ray sources that represent new and various levels of degradation, e.g., 20%, 50% and 80% degraded.

With respect to CT system 10, a substantially new and known acceptable x-ray source is operated so that the output beam impinges on x-ray detector array 18. Digitized signals I(x,y) generated by DAS 32 under such conditions are supplied to computer 36 which applies a hierarchical discrete wavelet transform (DWT) to the input signals I(x,y) where I represents intensity of the impinging beam and x and y represent locations in a Cartesian coordinate system. The DWT, in one form, is a four dimensional transform having highly localized characteristics in both frequency and spatial domains. Frequency domain changes are indicative of x-ray beam spectral changes and spatial domain changes are indicative of x-ray beam geometrical changes.

Thus the discrete wavelet transform of an image represented by signal I(x,y) is a four dimensional transform and is a function of the two spectral and the two spatial coordinates. The discrete wavelet transform (DWT) preferably is invertible and orthogonal. Thus, in a matrix form, the inverse transform matrix is simply the transpose of the direct transform.

The wavelet transform of a signal is a representation of the signal in terms of basis functions called the "mother functions" or "wavelets". Each wavelet function is well localized in space as well as in frequency or in scale. A particular set of wavelets is specified by a set of wavelet filter coefficients. An equation describing a two-dimensional wavelet transform is:

$$W(s_{x,y},\lambda_x,\lambda_y) = \int_y \int_x I_{(x,y)} h_{s_{x,y}}(x,y)\, d\lambda x\, d\lambda y \tag{1}$$

where $S_{x,y}$ is a wavelet scale parameter, x and y represent the x and y directions, respectively, $\lambda_x$ is the integral parameter across x, $\lambda_y$ is the integral parameter across y, $h_{s_{x,y}}$ is the wavelet impulse response function at scale $S_{x,y}$ and W is the wavelet coefficients at scale $S_{x,y}$.

The energy, or spectral parameter ("P"), associated with each wavelet transform scale $S_{x,y}$ is assigned a value according to:

$$P_{Sx,y} = \left\{ \sum_y \sum_x |W(s_{x,y},\lambda_x,\lambda_y)| \right\}, \tag{2}$$

Energy values $P_{Sx,y}$ are determined for first wavelet spatial frequency bands, namely, the low-high (LH), high-low (HL) and high-high (HH) wavelet spatial frequency bands of the optical focal spot image. The energy values $P_{Sx,y}$ are stored in a memory associated with computer 36, e.g., mass storage 38. The above described process is then repeated for the 20%, 50% and 80% degraded x-ray sources. Wavelet transforms are well known and further details regarding wavelet transforms are set forth, for example, in Daubeschies, "The Wavelet Transform, Time-Frequency Localization and Signal Analysis", IEEE Transactions On Information Theory, Vol. 36, No. 5, September, 1990, pages 961–1005.

When energy values $P_{Sx,y}$ are generated as set forth above, a continuum of parameter values representing various tube life expectancy values is generated using, for example, curve fitting. The parameter values are then stored in a look-up table format in memory. In the look-up table, each energy value P represents the expected energy level for an optical focal spot of a particular x-ray source having a known life expectancy, which also is stored in the look-up table with the respective energy levels.

To estimate the remaining life of x-ray source 14, output signals I(x,y) from DAS 32 are sampled by computer 36. As when generating the look-up table, the wavelet transform is applied at step 102 of FIG. 4 to such output signals I(x,y) as described above to generate energy values $P_{new}$ at step 104 for wavelet scale zero spatial frequency bands LH, HL and HH.

The new energy levels $P_{new}$ associated with operating x-ray source 14 are compared at step 106 to energy levels $P_{stored}$ obtained from the look-up table at step 108. Particularly, for each of the scale zero wavelet spatial frequency bands, stored energy levels $P_{stored}$ are subtracted from energy level $P_{new}$. Once a value for $P_{stored}$ which provides a statistically non-significant value when subtracted from $P_{new}$ has been identified, the estimated life for such value of $P_{stored}$ is identified at step 110 from the previously generated look-up table. For example, the $P_{stored}$ value may be associated with a tube which has expended only 80% of its life expectancy. Statistical significance can be determined using any technique for measuring statistical distance, such as the test of outliers as is well known in the art.

Once the estimated tube life expectancy has been determined for each of the three scale zero wavelet bands (LH, HL, HH), a comparison is performed at step 112 to determine whether, for any particular band, the expected remaining tube life is less than 20% of the total tube life expectancy. If the remaining tube life is less than 20% of the total tube life expectancy, then at step 114 computer 36 generates a message for display at console 40. The message may suggest that x-ray source 14 be replaced or at least checked further. If the remaining tube life is greater than or equal to 20% of the total tube life expected, the monitoring process is repeated on a periodic basis. Of course, values other than 20% of total tube life expectancy could be used as a threshold for recommending replacement.

After a period of use, the x-ray tube optical focal spot typically will be different either spatially and/or in frequency from the initial optical focal spot image. Therefore, and as described above, life expectancy of the tube may be predicted by comparing energy values obtained from the wavelet transform.

The above described method and system enable quick and easy detection of potential x-ray source failures. In addition, by assessing x-ray source life expectancy, unexpected x-ray source failures can be avoided. As previously explained, avoiding x-ray source failures is particularly important when performing a patient scan.

While only certain preferred features of the invention have been described and illustrated herein, many modifications and changes will occur to those skilled in the art. For example, the x-ray imaging system described herein is a "third generation" CT system in which both the x-ray source and detector rotate with the gantry. Various other x-ray imaging systems, including "fourth generation" systems wherein the detector is a full-ring stationary detector and only the x-ray source rotates with the gantry, may alternatively be used. Accordingly, it is to be understood that the appended claims are intended to cover all such modifications and changes as fall within the true spirit of the invention.

What is claimed is:

1. A method for estimating remaining life of an operating x-ray source, the x-ray source being at least partially optically aligned with a detector array so that an x-ray beam produced by the x-ray source at least partially impinges on the detector array at an optical focal spot, wherein focal spot spectral parameters $P_{stored}$ represent optical focal spot energy levels for different x-ray source life expectancy values stored in a look-up table, said method comprising the steps of:

sampling signals I(x,y) representative of the x-ray beam optical focal spot detected by the detector array, where I represents beam intensity and x and y represent beam spot locations in a Cartesian coordinate system;

applying a wavelet transform to the sampled signals I(x,y) to generate at least one energy level $P_{new}$ for a wavelet band;

comparing energy level $P_{new}$ with stored energy levels $P_{stored}$ to identify one of said energy levels $P_{stored}$ which, when subtracted from energy level $P_{new}$, results in a statistically non-significant value; and estimating the remaining life of the x-ray source as being equal to the life expectancy value corresponding to the identified energy level $P_{stored}$.

2. The method of claim 1 wherein the wavelet transform is a hierarchical discrete wavelet transform represented as:

$$W(s_{x,y},\lambda_x,\lambda_y)=\int_y\int_x I_{(x,y)}h_{s_{x,y}}(x,y)d\lambda x d\lambda y$$

where $S_{x,y}$ is a wavelet scale parameter, x and y represent the x and y directions, respectively, $\lambda_x$ is the integral parameter across x, $\lambda_y$ is an integral parameter across y, $h_{s_{x,y}}$ is the wavelet impulse response function at scale $S_{x,y}$ and W is the wavelet coefficients at scale $S_{x,y}$.

3. The method of claim 2 wherein each wavelet transform scale is assigned an energy value $P_{Sx,y}$ in accordance with:

$$P_{Sx,y}=\left\{\sum_y\sum_x |W(s_{x,y},\lambda_x,\lambda_y)|\right\}.$$

4. The method of claim 1 wherein energy values $P_{Sx,y}$ are determined for first wavelet spatial frequency bands including low-high (LH), high-low (HL) and high-high (HH) wavelet spatial frequency bands.

5. The method of claim 1 comprising the additional steps of:

determining whether the estimated remaining life is less than a predetermined value; and providing an indication that the x-ray source should be replaced if the estimated remaining life is less than the predetermined value.

6. The method of claim 5 wherein the predetermined value is approximately equal to twenty percent of the total x-ray source life expectancy.

7. A system for estimating remaining life of an operating x-ray source, the x-ray source being at least partially optically aligned with a detector array so that an x-ray beam produced by the x-ray source at least partially impinges on the detector array at an optical focal spot, said system comprising:

a memory element having focal spot spectral parameters $P_{stored}$ representing optical focal spot energy levels for different life expectancy values stored therein; and processor means coupled to said memory element and adapted to perform the operations of:

sampling signals I(x,y) representative of the x-ray beam optical focal spot detected by the detector array, where I represents beam intensity and x and y represent beam spot locations in a Cartesian coordinate system;

applying a wavelet transform to the sampled signals I(x,y) to generate at least one energy level $P_{new}$ for a wavelet band;

comparing energy level $P_{new}$ with stored energy levels $P_{stored}$ to identify one of said energy levels $P_{stored}$ which, when subtracted from energy level $P_{new}$, results in a statistically non-significant value; and estimating the remaining life of the x-ray source as being equal to the life expectancy value corresponding to the identified energy level $P_{stored}$.

8. The system of claim 7 wherein the wavelet transform is a hierarchical discrete wavelet transform represented as:

$$W(s_{x,y},\lambda_x,\lambda_y)=\int_y\int_x I_{(x,y)}h_{s_{x,y}}(x,y)d\lambda x d\lambda y$$

where $S_{x,y}$ is a wavelet scale parameter, x and y represent the x and y directions, respectively, $\lambda_x$ is the integral parameter across x, $\lambda_y$ is an integral parameter across y, $h_{s_{x,y}}$ is the wavelet impulse response function at scale $S_{x,y}$ and W is the wavelet coefficients at scale $S_{x,y}$.

9. The system of claim 8 wherein each wavelet transform is assigned an energy value $P_{Sx,y}$ in accordance with:

$$P_{Sx,y}=\left\{\sum_y\sum_x |W(s_{x,y},\lambda_x,\lambda_y)|\right\}.$$

10. The system of claim 7 wherein energy values $P_{Sx,y}$ are determined for first wavelet spatial frequency bands including low-high (LH), high-low (HL) and high-high (HH) wavelet spatial frequency bands.

11. The system of claim 7 wherein said processor means is further adapted to perform the operations of:

determining whether the estimated remaining life is less than a predetermined value; and providing an indication that the x-ray source should be replaced if the estimated remaining life is less than the predetermined value.

12. The system of claim 7 wherein the predetermined value is approximately equal to twenty percent of the total x-ray source life expectancy.

13. The system of claim 7 wherein said processor means comprises a computer programmed to perform the recited operations.

14. The system of claim 11 wherein said processor means comprises a computer programmed to perform the recited operations.

* * * * *